US005783910A

United States Patent [19]

Casper et al.

[11] Patent Number: 5,783,910

[45] Date of Patent: *Jul. 21, 1998

[54] FLAT PANEL DISPLAY IN WHICH LOW-VOLTAGE ROW AND COLUMN ADDRESS SIGNALS CONTROL A MUCH HIGHER PIXEL ACTIVATION VOLTAGE

[75] Inventors: Stephen L. Casper; Glen E. Hush; Thomas W. Voshell, all of Boise, Id.

[73] Assignee: Micron Technology, Inc., Boise, Id.

[ * ] Notice: The term of this patent shall not extend beyond the expiration date of Pat. No. 5,357,172.

[21] Appl. No.: 790,205

[22] Filed: Feb. 5, 1997

Related U.S. Application Data

[63] Continuation of Ser. No. 530,562, Sep. 19, 1995, Pat. No. 5,616,991, and a continuation-in-part of Ser. No. 311,971, Sep. 26, 1994, Ser. No. 458,853, Jun. 2, 1995, Pat. No. 5,638,086, and Ser. No. 582,381, Jan. 9, 1996, which is a continuation of Ser. No. 305,107, Sep. 13, 1994, abandoned, which is a continuation of Ser. No. 102,598, Aug. 5, 1993, abandoned, which is a continuation-in-part of Ser. No. 60,111, May 11, 1993, abandoned, said Ser. No. 453,853, is a continuation of Ser. No. 138,535, Oct. 15, 1993, abandoned, and a continuation-in-part of Ser. No. 77,181, Jun. 15, 1993, Pat. No. 5,410,218, said Ser. No. 311,971, is a continuation of Ser. No. 60,111, said Ser. No. 530,562, is a continuation of Ser. No. 209,579, Mar. 11, 1994, abandoned, which is a continuation-in-part of Ser. No. 11,927, Feb. 1, 1993, Pat. No. 5,357,172, which is a continuation-in-part of Ser. No. 864,702, Apr. 7, 1992, Pat. No. 5,210,472.

[51] Int. Cl.[6] ..... H05B 33/12; H05B 41/36; H05B 41/392

[52] U.S. Cl. ..... 315/167; 315/169.3; 315/210; 315/226; 315/260; 315/315; 315/DIG. 7

[58] Field of Search ..... 315/167, 169.1, 315/169.3, 169.4, 210, 226, 260, 315, 349, DIG. 7

[56] References Cited

U.S. PATENT DOCUMENTS

| | | | |
|---|---|---|---|
| 3,329,949 | 7/1967 | Colton et al. | 315/334 |
| 3,611,022 | 10/1971 | Galusha | 315/169.4 X |
| 4,348,616 | 9/1982 | Tanaka et al. | 315/315 X |
| 4,691,145 | 9/1987 | Satoh | 315/260 X |
| 4,857,799 | 8/1989 | Spindt et al. | 313/495 |
| 4,908,539 | 3/1990 | Meyer | 315/169.3 |
| 4,940,916 | 7/1990 | Borel et al. | 313/306 |
| 5,028,844 | 7/1991 | Sakaguchi et al. | 315/226 X |
| 5,036,317 | 7/1991 | Buzak | 340/783 |
| 5,103,144 | 4/1992 | Dunham | 315/366 |
| 5,153,483 | 10/1992 | Kishino et al. | 315/3 |
| 5,157,309 | 10/1992 | Parker et al. | 315/169.1 |
| 5,162,704 | 11/1992 | Kobori et al. | 315/349 |

(List continued on next page.)

*Primary Examiner*—David Mis
*Attorney, Agent, or Firm*—Angus C. Fox, III; Robert J. Stern

[57] ABSTRACT

This invention is directed to an improvement of a field emission display architecture in which low-voltage row and column address signals control a much higher pixel activation voltage. Instead of using a pair of series-coupled transistors the emitter node grounding path as in the original architecture (one of which is gated by a column signal d the other of which is gated by a row signal), only a single transistor is utilized in the emitter node grounding path thus eliminating an intermediate node between the two transistors that was responsible for unwanted emissions under certain operating conditions. In a preferred embodiment of the invention, a current regulating resistor is placed in the grounding path in series with the primary grounding transistor, with the resistor being directly coupled to ground. Additionally, for the preferred embodiment of the invention, the gate of the grounding transistor is coupled via a second field-effect transistor to either a row signal or a column signal. In the case where the gate of the first transistor is coupled to a row signal, the gate of the second transistor is coupled to a column signal. Likewise, where the gate of the first transistor is coupled to a column signal, the gate of the second transistor is coupled to a row signal. Numerous other equivalent circuits are possible, and several examples of such equivalent circuits are depicted in this disclosure.

36 Claims, 3 Drawing Sheets

U.S. PATENT DOCUMENTS

| | | | |
|---|---|---|---|
| 5,212,426 | 5/1993 | Kane | 315/169.1 |
| 5,283,500 | 2/1994 | Kochanski | 315/58 |
| 5,313,140 | 5/1994 | Smith | 315/169.1 |
| 5,357,172 | 10/1994 | Lee et al. | 315/167 |
| 5,359,256 | 10/1994 | Gray | 313/169 |
| 5,387,844 | 2/1995 | Browning | 315/169.3 |
| 5,410,218 | 4/1995 | Hush | 315/169.1 |
| 5,459,480 | 10/1995 | Browning et al. | 345/75 |
| 5,598,156 | 1/1997 | Hush et al. | 341/100 |
| 5,616,991 | 4/1997 | Casper et al. | 315/167 |
| 5,642,017 | 6/1997 | Hush | 315/169.3 |

FLAT PANEL DISPLAY IN WHICH LOW-VOLTAGE ROW AND COLUMN ADDRESS SIGNALS CONTROL A MUCH HIGHER PIXEL ACTIVATION VOLTAGE

This application is a continuation of application Ser. No. 08/530,562 filed Sep. 19, 1995 now U.S. Pat. No. 5,616,991; which is a continuation of application Ser. No. 08/209,579 filed Mar. 11, 1994, now abandoned; which is a continuation-in-part of application Ser. No. 08/011,927 that was filed on Feb. 1, 1993, now U.S. Pat. No. 5,357,172, which in turn, is a continuation-in-part of application Ser. No. 07/864,702 that was filed on Apr. 7, 1992 and is now issued U.S. Pat. No. 5,210,472.

This application also is a continuation-in-part of application Ser. No. 08/458,853 filed Jun. 2, 1995 by Lee et al, now U.S. Pat. No. 5,638,086; which is a continuation of application Ser. No. 08/138,535 filed Oct. 15, 1993, now abandoned; and which is a continuation-in-part of application Ser. No. 08/077,181 filed Jun. 15, 1993, now U.S. Pat. No. 5,410,218. This application also is a continuation-in-part of copending application Ser. No. 08/311,971 filed Sep. 26, 1994 by Hush et al., which is a continuation of application Ser. No. 08/060,111 filed May 11, 1993, now abandoned. This application also is a continuation-in-part of copending application Ser. No. 08/582,381 filed Jan. 11, 1996, which is a continuation of Ser. No. 08/305,107 filed Sep. 13, 1994 by Hush et al., now abandoned, which is a continuation of application Ser. No. 08/102,598 filed Aug. 5, 1993, now abandoned, which is a continuation-in-part of application Ser. No. 08/060,111 filed May 11, 1993, now abandoned.

FIELD OF THE INVENTION

This invention relates to flat panel displays and, more particularly, to effective current regulation in a matrix-addressable flat panel display in which low-voltage row and column address signals control a much higher pixel activation voltage. This invention not only permits the use of row and column signal voltages that are compatible with standard integrated circuit logic levels, but also provides regulated, low-current operation that extends cathode life expectancy and reduces power consumption requirements.

BACKGROUND OF THE INVENTION

For more than half a century, the cathode ray tube (CRT) has been the principal device for displaying visual information. Although CRTs have been endowed during that period with remarkable display characteristics in the areas of color, brightness, contrast and resolution, they have remained relatively bulky and power hungry. The advent of portable computers has created intense demand for displays which are lightweight, compact, and power efficient. Although liquid crystal displays are now used almost universally for laptop computers, contrast is poor in comparison to CRTs, only a limited range of viewing angles is possible, and in color versions, they consume power at rates which are incompatible with extended battery operation. In addition, color screens tend to be far more costly than CRTs of equal screen size.

As a result of the drawbacks of liquid crystal display technology, thin film field emission display technology has been receiving increasing attention by industry. Flat panel display utilizing such technology employ a matrix-addressable array of pointed, thin-film, cold field emission cathodes in combination with a phosphor-luminescent screen. Somewhat analogous to a cathode ray tube, individual field emission structures are sometimes referred to as vacuum microelectronic triodes. The triode elements are a cathode (emitter tip), a grid (also referred to as the gate), and an anode (typically, the phosphor-coated element to which emitted electrons are directed).

Although the phenomenon of field emission was discovered in the 1950's, extensive research by many individuals, such as Charles A. Spindt of SRI International, has improved the technology to the extent that its prospects for use in the manufacture of inexpensive, low-power, high-resolution, high-contrast, full-color flat displays appear promising. However, much work remains to be done in order to successfully commercialize the technology.

There are a number of problems associated with contemporary matrix-addressable field-emission display designs. To date, such displays have been constructed such that a column signal activates a single conductive strip within the grid, while a row signal activates a conductive strip within the emitter base electrode. At the intersection of an activated column and an activated row, a grid-to-emitter voltage differential sufficient to induce field emission will exist, causing illumination of an associated phosphor on the phosphorescent screen. In FIG. 1, which is representative of such contemporary architecture, three grid (grid) strips 11A, 11B, and 11C orthogonally intersect a trio of emitter base electrode (row) strips 12A, 12B, and 12C. In this representation, each row-column intersection (the equivalent of a single pixel within the display) contains 16 field emission cathodes (also referred to herein as "emitters") 13. In reality, the number of emitter tips per pixel may vary greatly. The tip of each emitter tip is surrounded by a grid strip aperture 14. In order for field emission to occur, the voltage differential between a row conductor and a column conductor must be at least equal to a voltage which will provide acceptable field emission levels. Field emission intensity is highly dependent on several factors, the most important of which is the sharpness of the cathode emitter tip and the intensity of the electric field at the tip. Although a level of field emission suitable for the operation of flat panel displays has been achieved with emitter-to-grid voltages as low as 80 volts (and this figure is expected to decrease in the coming years due to improvements in emitter structure design and fabrication) emission voltages will probably remain far greater than 5 volts, which is the standard CMOS, NMOS, and TTL "1" level. Thus, if the field emission threshold voltage is at 80 volts, row and column lines will, most probably, be designed to switch between 0 and either +40 or −40 volts in order to provide an intersection voltage differential of 80 volts. Hence, it will be necessary to perform high-voltage switching as these row and column lines are activated. Not only is there a problem of building drivers to switch such high voltages, but there is also the problem of unnecessary power consumption because of the capacitive coupling of row and column lines. That is to say, the higher the voltage on these lines, the greater the power required to drive the display.

In addition to the problem of high-voltage switching, aperture displays suffer from low yield and low reliability due to the possibility of emitter-to-grid shorts. Such a short affects the voltage differential between the emitters and grid within the entire array, and may well render the entire array useless, either by consuming so much power that the supply is not able to maintain a voltage differential sufficient to induce field emission, or by actually generating so much heat that a portion of the array is actually destroyed.

A new field emission display architecture, which is the subject of U.S. Pat. No. 5,210,472, overcomes the problems of high-voltage switching and emitter-to-grid shorts, which, in turn, ameliorates the problem of display power consumption. The new architecture (hereinafter referred to as the "low-voltage-switching field emission display architecture") permits the switching of a high pixel activation voltage with low signal voltages that are compatible with standard CMOS, NMOS, or other integrated circuit logic levels. Instead of having row and columns tied directly to the cathode array, they are used to gate at least one pair of series-connected field effect transistors (FETs), each pair when conductive coupling the base electrode of a single emitter node to a potential that is sufficiently low, with respect to a higher potential applied to the grid, to induce field emission. Each row-column intersection (i.e. pixel) within the display may contain multiple emitter nodes in order to improve manufacturing yield and product reliability. In a preferred embodiment, the grid of the array is held at a constant potential ($V_{FE}$), which is consistent with reliable field emission when the emitters are at ground potential. A multiplicity of emitter nodes are employed, one or more of which correspond to a single pixel (i.e., row and column intersection). Each emitter node has its own base electrode, which is groundable through its own pair of series-coupled field-effect transistors by applying a signal voltage to both the row and column lines associated with that emitter node. One of the series-connected FETs is gated by a signal on the row line; the other FET is gated by a signal on the column line. Also in the preferred embodiment of the invention, each emitter node contains multiple cathode emitters. Hence, each row-column intersection controls multiple pairs of series-coupled FETs, and each pair controls a single emitter node (pixel) containing multiple emitters.

The regulation of cathode-to-grid current has become a major issue in the design of field emission displays, as the issues of cathode life expectancy, low power consumption, and stability requirements are addressed.

The issue of current regulation has been addressed with respect to conventionally constructed flat panel field emission displays, such as the one depicted in FIG. 1. For example, in U.S. Pat. No. 4,940,916, Michel Borel and three colleagues disclose a field emission display having a resistive layer between each cathode (emitter tip) and an underlying conductive layer. In a subsequent U.S. Pat. No. 5,162,704, Yoichi Bobori and Mitsuru Tanaka disclose a field emission display having a diode in series with each emitter tip.

In U.S. patent application Ser. No. 08/011,927, which has become U.S. Pat. No. 5,357,172, a method is disclosed for reducing power consumption and enhancing reliability and stability in the low-voltage switching field emission display architecture by regulating cathode emission current. This is achieved by placing a resistor in series with each pair of series-coupled low-voltage switching MOSFETs. As heretofore explained, each MOSFET pair couples an emitter node, which contains one or more field emitter tips, to ground. The resistor is coupled directly to the ground bus and to the source of the MOSFET furthest from the emitter node. By coupling the current-regulating resistor directly to the ground bus, stable current values independent of cathode voltage are achieved over a wide range of cathode voltages.

Prototypes of the low-voltage switching field emission display architecture which incorporate the current-regulating resistors in the emitter grounding circuits have been constructed by Micron Display Technology, Inc., a subsidiary of Micron Technology, Inc. of Boise, Id. FIG. 2 is representative of such a prototype display. In the display of FIG. 2, a single emitter node is characterized by a conductive grid (also referred to as a first pixel element) 21, which is continuous throughout the entire array, and which is maintained at a constant potential, $V_{GRID}$. Each pixel element within the array is illuminated by an emitter group (not shown). In order to enhance product reliability and manufacturing yield, each emitter group comprises multiple emitter nodes, and each node contains multiple field emission cathodes. Although the single emitter node depicted by FIG. 2 has only three emitters (22A, 22B, and 22C), the actual number may be much higher. Each of the emitters 22 is connected to a base electrode 23 that is common to only the emitters of a single emitter node. In order to induce field emission, base electrode 23 is grounded through a pair of series-coupled field-effect transistors $Q_C$ and $Q_R$ and current-regulating resistor R. Resistor R is interposed between the source of transistor $Q_R$ and ground. Transistor $Q_C$ is gated by a column line signal $S_C$, while transistor $Q_R$ is gated by a row line signal $S_R$. Standard logic signal voltages for CMOS, NMOS, TTL and other integrated circuits are generally 5 volts or less, and may be used for both column and row line signals. A pixel is turned off (i.e., placed in a non-emitting state) by turning off either or both of the series-connected FETs ($Q_C$ and $Q_R$). From the moment that at least one of the FETs becomes non-conductive (i.e., the gate voltage $V_{GS}$ drops below the device threshold voltage $V_T$, electrons will continue to be discharged from the emitter tips corresponding to that pixel until the voltage differential between the base and the grid is just below emission threshold voltage. In order to improve yield and to minimize array power consumption, a fusible link FL is placed in series with the pull-down current path from base electrode 23 to ground via transistors $Q_C$ and $Q_R$. Fusible link FL may be blown during testing if a base-to-emitter short exists within that emitter group, thus isolating the shorted group from the rest of the array.

Although performance of the prototype displays has, in many respects, exceeded expectations, it has been noted that, under certain operating conditions, unintended pixel emission will continue even when the transistor nearest the emitter tip is turned "on" and the transistor nearest ground is turned "off". This problem is believed to be associated with the parasitic capacitance of the node between each pair of transistors in the pixel grounding path (hereinafter the intermediate node). The following sequence of events is the most likely cause of the phenomenon. The transistor nearest the emitter node is turned "off" by a low logic signal on its gate. Then, the transistor nearest ground is turned "off" by a low logic signal on its gate, resulting in the intermediate node being at ground potential. When the transistor nearest the emitter is then turned "on" by a high logic signal on its gate, the difference in potential between the emitter node and the grid is sufficient to cause field emission until the intermediate node has emitted a number of electrons sufficient to cause the difference in potential between the emitter node and the grid to drop below the emission threshold.

SUMMARY OF THE INVENTION

One aspect of the invention is an apparatus and method for controlling the current through a number of field emitters comprising a current regulating resistor and a transistor connected between the resistor and the field emitters. A related aspect of the invention is a field emission display including in each pixel -a current regulating resistor and a transistor connected between the resistor and the field emitters.

Another aspect of the invention is an improved emitter node grounding circuit. This invention is directed to a modification of the low-voltage switching field emission display architecture which solves the problem of unwanted emission when the grounding path is open. Instead of using a pair of series-coupled transistors in the emitter node grounding path (one of which is gated by a column signal and the other of which is gated by a row signal), only a single transistor is utilized in the emitter node grounding path, thus eliminating the intermediate node that was responsible for the unwanted emissions.

In all embodiments of the improved emitter node grounding circuit, the emitter node grounding path comprises a single primary grounding field-effect transistor that couples the emitter node to ground. In a preferred embodiment of the invention, a current regulating resistor is placed in the grounding path in series with the primary grounding transistor, with the resistor being directly coupled to ground. Additionally, for the preferred embodiment of the invention, the gate of the grounding transistor is coupled via a second field-effect transistor to either a row signal or a column signal. In the case where the gate of the first transistor is coupled to a row signal, the gate of the second transistor is coupled to a column signal. Likewise, where the gate of the first transistor is coupled to a column signal, the gate of th e second transistor is coupled to a row signal. Numerous other equivalent circuits are possible, and several examples of such equivalent circuits are depicted in this disclosure.

PREFERRED EMBODIMENTS OF THE INVENTION

Figure 1:
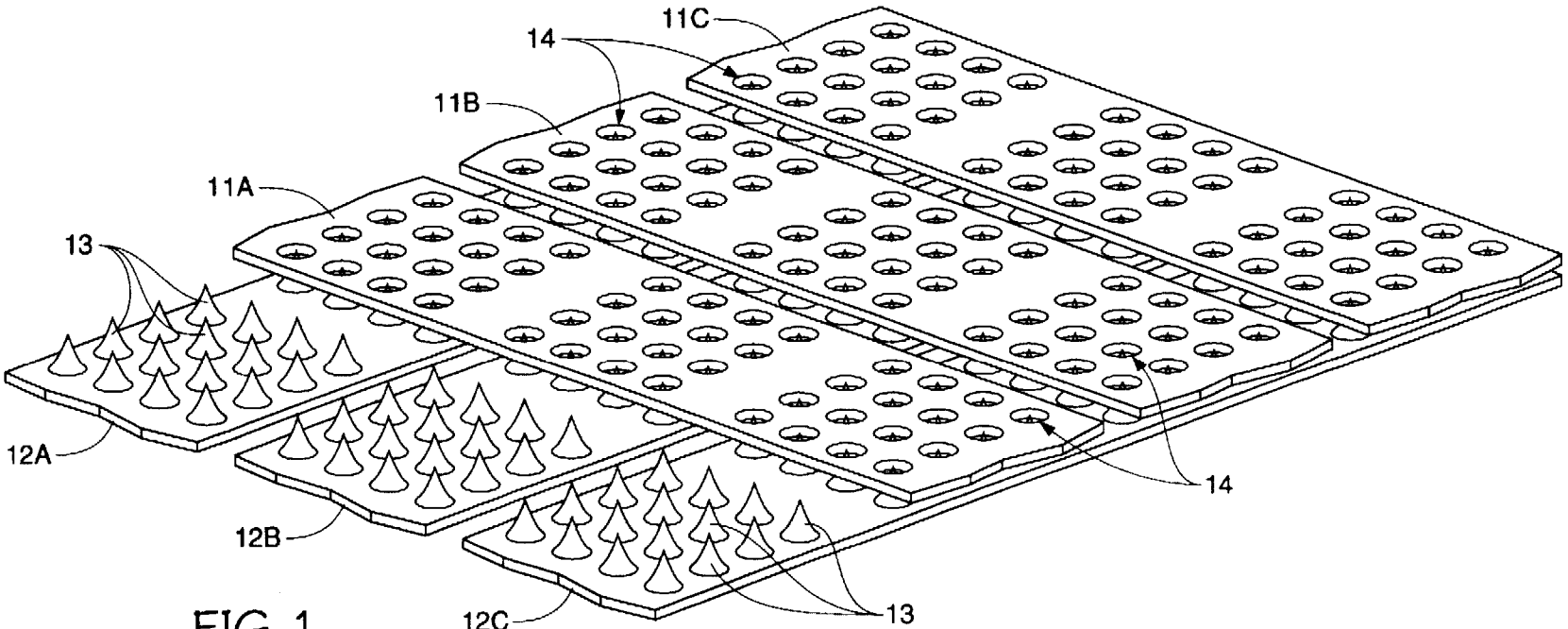
FIG. 1 (PRIOR ART)
FIG. 1 is a simplified perspective view of the grid and emitter base electrode structure in a contemporary conventional flat-panel field-emission display.
Figure 2:
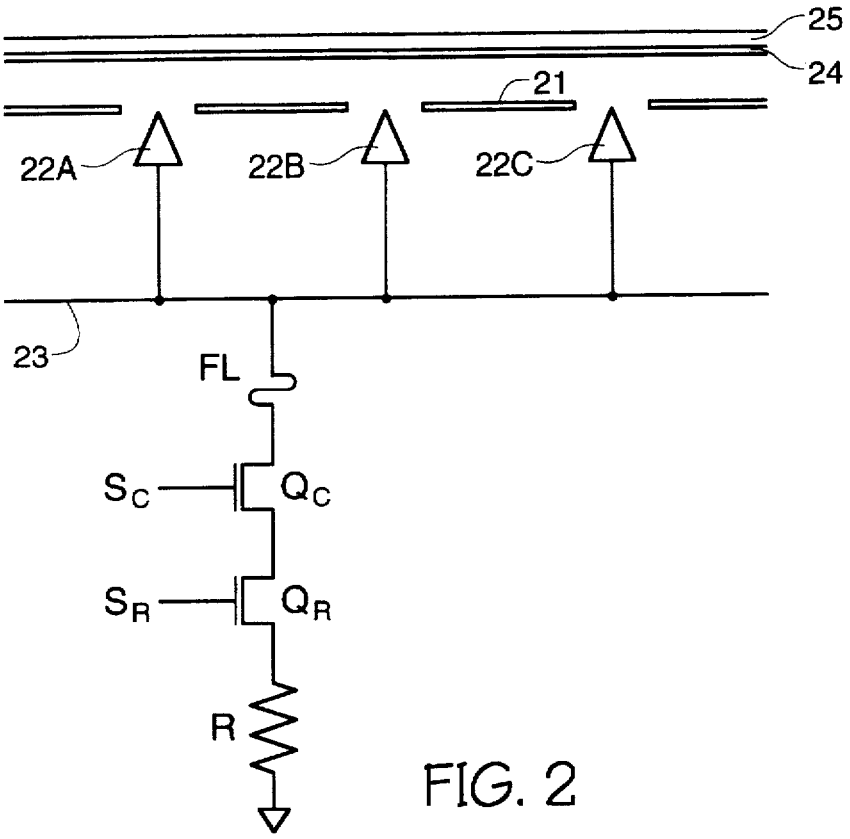
FIG. 2 is a schematic diagram of a single emitter node within the original low-voltage switching field emission display architecture that incorporates a current regulating resistor.
Figure 3:
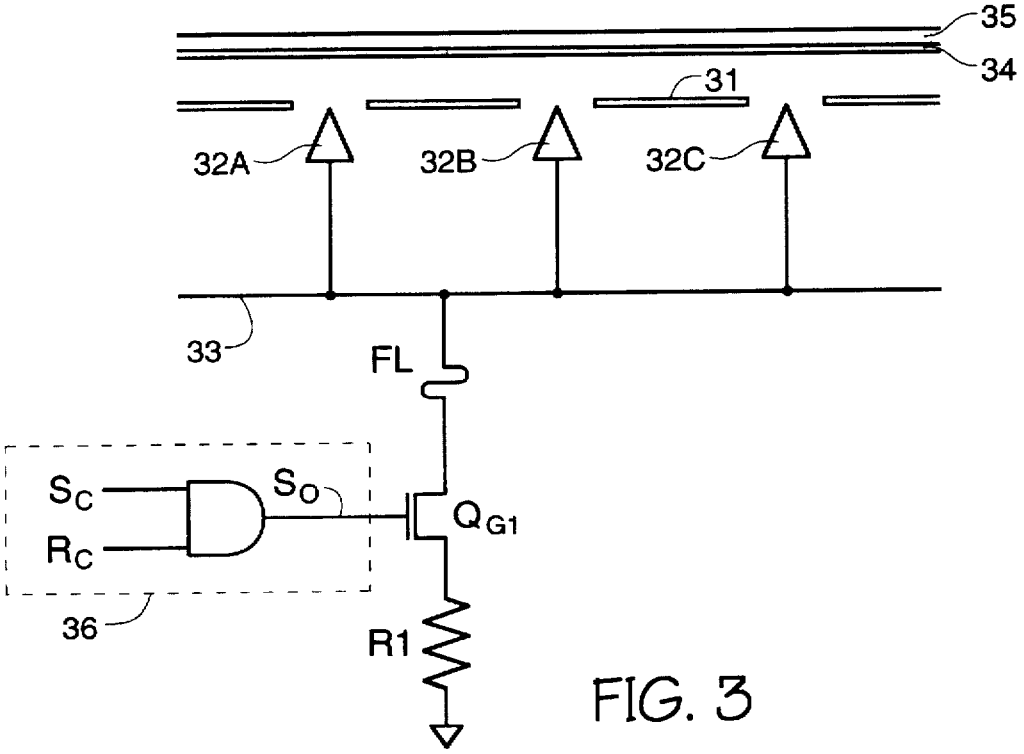
FIG. 3 is a schematic diagram of a single emitter node within the improved low-voltage switching field emission display architecture.

Referring now to FIG. 3, a single emitter node within the improved low-voltage switching field-emission display architecture is characterized by a conductive grid 31, which is continuous throughout the entire array, and which is maintained at a constant potential, $V_{GRID}$. In order to enhance product reliability and manufacturing yield, multiple emitter nodes are grouped for individual pixels within the display, and each node contains multiple field emission cathodes 32A, 32B, and 32C (also referred to as "field emitters" or "emitters"). Although the single emitter node depicted by FIG. 3 has only three emitters (32A, 32B, and 32C), the actual number may be much higher. Each of the emitters 32 is connected to a base electrode 33 that is common to only the emitters of a single emitter node, and which is insulated from the grid 31. In order to induce field emission, base electrode 33 is grounded through a single, primary grounding field-effect transistor $Q_{G1}$ and a current-regulating resistor R1. Resistor R1 is interposed between the source of transistor $Q_{G1}$ and ground. Pixel illumination occurs, when electrons emitted from the emitter tips strike a phosphor coating 34 on screen 35.

Still referring to FIG. 3, a fusible link FL is placed in series with the pull-down current path from base electrode 33 to ground via transistors $Q_{G1}$ and resistor R1. Fusible link FL may be blown during testing if a base-to-emitter short exists within that emitter group, thus isolating the shorted group from the rest of the array in order to improve yield and to minimize array power consumption. It should be noted that the position of fusible link FL within the grounding path is inconsequential (i.e., it may be located between the base electrode 33 and the grounding transistor $Q_{G1}$, as actually shown in FIG. 3, between ground and resistor R1, or between resistor R1 and the grounding transistor $Q_{G1}$).

Figure 4:
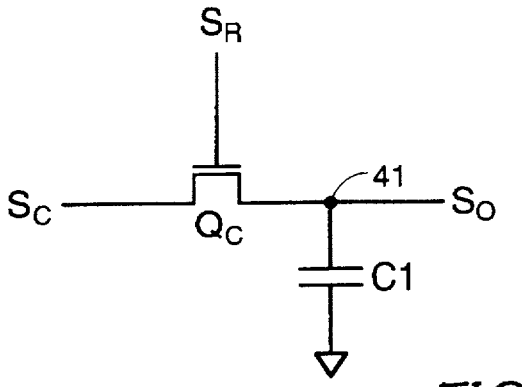
FIG. 4 is a schematic diagram of a preferred embodiment circuit used to gate the grounding transistor.

Still referring to FIG. 3, for all embodiments of the improved low-voltage switching field-emission display architecture, transistor $Q_{G1}$ is gated by an output signal $S_O$, which is the product of a logic function having, as inputs, the signal on a column line signal $S_C$ and the signal on a row line signal $S_R$. The logic function, which is represented by block 36, can be generated in a variety of ways. FIG. 4 depicts the circuitry that the inventor deems to be the preferred means of generating the logic function. Other circuits, possessing various degrees of equivalency, are depicted in drawings FIGS. 5 through 8. Standard logic signal voltages for CMOS, NMOS, TTL and other integrated circuits are generally 5 volts or less, and may be used for both column and row line signals. An emitter node is turned off (i.e., placed in a non-emitting state) by cutting current flow through grounding transistor $Q_{G1}$ and resistor R1. From the moment that transistor $Q_{G1}$ becomes non-conductive (i.e., the gate voltage $V_{GS}$ drops below the device threshold voltage $V_T$, electrons will continue to be discharged from the emitter tips corresponding to that pixel until the voltage differential between the base and the grid is just below emission threshold voltage.

With further reference to FIG. 3, gray scaling (i.e., variations in pixel illumination) for the improved low-voltage switching field-emission display architecture is accomplished by varying the duty cycle (i.e. the period that the emitters within a pixel are actually emitting as a percentage of frame time). Brightness control is accomplished by varying the emitter current by varying the gate voltage on transistor $Q_{G1}$. Although duty cycle may be varied with equal ease for all embodiments of the logic function disclosed herein, certain embodiments lend themselves more easily to emitter current control.

Referring now to FIG. 4, which is the first and preferred embodiment of the logic function 36 generally depicted in FIG. 3, output signal $S_O$ is generated by coupling a column address signal line $S_C$ to the gate of grounding transistor $Q_{G1}$ through a control transistor $Q_C$. The gate of control transistor $Q_C$ is coupled to a row address signal line $S_R$. An identical result is obtained by coupling the row address signal line $S_R$ to the gate of transistor $Q_G$ through control transistor $Q_C$ and coupling the column address signal line $S_C$ to the gate of transistor $Q_C$. In either case, the circuit operates as an AND gate. An optional capacitor C1 is coupled between ground and node 41, which is common to the gate of grounding transistor $Q_{G1}$ and the source of control transistor $Q_C$. This added capacitance ensures that the emitter will remain on during a complete scan cycle. The capacitor C1 is discharged to the voltage level on the drain 43 of control transistor $Q_C$ when control transistor $Q_C$ is on. As a practical matter, the gate of grounding transistor $Q_{G1}$ has a certain amount of parasitic capacitance. Thus, a discrete capacitor, such as capacitor C1, may not be essential for circuit functionality. In addition, the decay properties of the phosphor on the screen of the display are also capable of maintaining pixel illumination between scans. This embodiment of the logic function of $S_R$ and $S_C$ is particularly advantageous, as the row and column signals do not control an independent high logic voltage that would other wise require routing to each pixel. This embodiment also lends itself well to both duty cycle control and emitter current control. Duty cycle control may be implemented by either pulsing the signal that is coupled to the gate of grounding transistor $Q_{G1}$, or pulsing the signal that is coupled to the gate of control transistor $Q_C$. Emitter current may be varied by either varying the gate voltage on transistor $Q_{G1}$, or the gate voltage on transistor $Q_C$.

Figure 5:
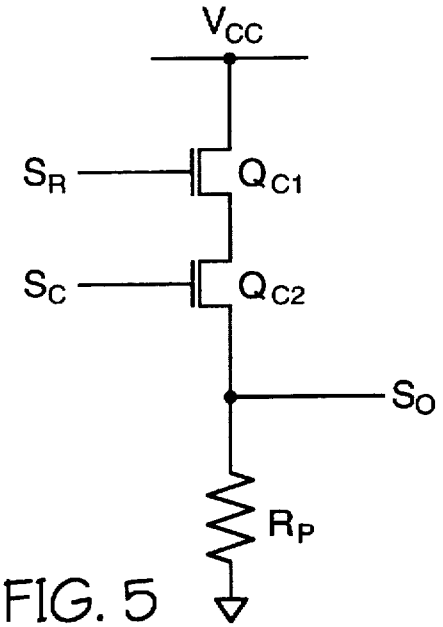
FIG. 5 is a schematic diagram of a second embodiment circuit used to gate the grounding transistor.

Referring now to FIG. 5, which is the second embodiment of the logic function 36 generally depicted in FIG. 3, output signal $S_0$ is generated by coupling a high logic level voltage $V_{CC}$ to the gate of grounding transistor $Q_{G1}$ through a pair of series connected field-effect control transistors $Q_{C1}$ and $Q_{C1}$, one of which is controlled by a column address signal $S_C$, and the other of which is controlled by a row address signal $S_R$. A pull-down resistor $R_p$ is required in order to pull down the voltage on the gate of grounding transistor $Q_{G1}$ during periods of pixel inactivity (i.e., during scans when at least one either the column address signal $S_C$ or the row address signal $S_R$ is low. This embodiment of the logical AND function has several disadvantages. Firstly, there is power dissipation through pull-down resistor $R_p$ whenever transistor $Q_G$ is conductive. For portable equipment, this may be a significant drawback. Secondly, the high logic voltage $V_{CC}$ must be routed to every pixel within the display, greatly complicating the layout as compared with the embodiment of FIG. 4. In this embodiment of the logical AND function, duty cycle control may be implemented by pulsing either of the signals $S_R$ or $S_C$, and emitter current may be varied by varying the gate voltage on either transistor $Q_{C1}$ or $Q_{C2}$.

Figure 6:
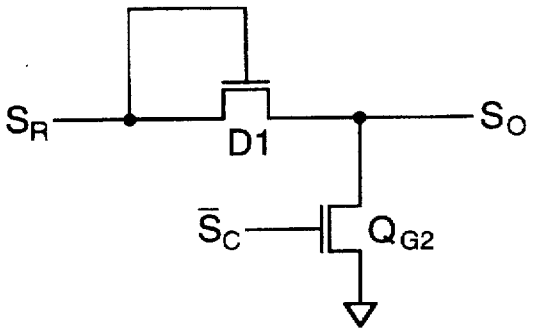
FIG. 6 is a schematic diagram of a third embodiment circuit used to gate the grounding transistor.

Referring now to FIG. 6, which is the second embodiment of the logic function 36 generally depicted in FIG. 3, output signal $S_0$ is generated by coupling one of either a row address signal or a column address signal to the gate of grounding transistor $Q_{G1}$ (see FIG. 3) through a diode D1 which is on when the signal is high. The gate of grounding transistor $Q_{G1}$ is also coupled to ground through a secondary grounding transistor $Q_{G2}$. The secondary grounding transistor $Q_{G2}$ is controlled by the complement of the address signal not coupled to the gate of ground transistor $Q_G$. That is, if (as shown in FIG. 6) the row address signal $S_R$ is coupled to the gate of transistor $Q_{G1}$, then the complement of the column address signal $S_C$ is coupled to the gate of transistor $Q_{G2}$, and visa versa. This embodiment of the logical AND function has the disadvantage that power is dissipated through transistor $Q_{G2}$ whenever diode Dl is conducting and the column signal $S_C$* is active (i.e., whenever the pixel group controlled by transistor $Q_{G1}$ is selected).

Although only several embodiments of the invention have been disclosed in detail herein, it will be obvious to those having ordinary skill in the art that changes and modifications may be made thereto without departing from the scope and spirit of the invention as claimed. For example, although the logic function 36 of FIG. 3 is represented as an AND gate, other equivalent logical operations (e.g., NAND, OR, XOR, NOR operations) could be used if the signals $S_R$ and $S_C$ are inverted. While the particular embodiments herein depicted and described are fully capable of attaining the objectives and providing the advantages hereinbefore stated, it is to be understood that this disclosure is meant to be merely illustrative of the presently-preferred embodiment and certain other less-preferred embodiments of the invention, and that no limitations are intended with regard to the details of construction or design thereof beyond the limitations imposed by the appended claims.

We claim:

1. An improved field emission display comprising:

multiple row address lines;

multiple column address lines;

said row address lines intersecting said column address lines, with the intersection of a single row address line with a single column address line being associated with a single pixel within said display;

a grid which is common to the entire display, and which is held at a first potential;

a plurality of pixels, wherein each pixel includes a group of field emission cathodes, wherein connecting the cathodes to a potential sufficiently low relative to said first potential will induce field emission;

a logical AND gate circuit having an output and first and second inputs for receiving first and second input signals, respectively, one of said inputs being coupled to that pixel's respective row address line, and the other input being coupled to that pixel's column address line, wherein the logical AND gate circuit produces at its output a signal which is a logical AND of the first and second input signals;

a first transistor having gate, drain, and source terminals, the gate being connected to the output of the gate circuit, and the drain being connected to the field emission cathodes in said group: and a resistance connected between a second potential and the source terminal of the first transistor, the second potential being less than said potential sufficient to induce field emission.

2. The improved field emission display of claim 1, wherein said second potential is ground potential.

3. The improved field emission display of claim 1, wherein said logical AND gate circuit comprises a second transistor having gate, source, and drain terminals, the gate of the second transistor being connected to the first input of the gate circuit, the source of the second transistor being connected to the second input of the gate circuit, and the drain of the second transistor being connected to the output of the gate circuit.

4. The improved field emission display of claim 3, wherein said logical AND gate circuit further comprises a capacitor coupled between said second potential and the gate of the first transistor.

5. The improved field emission display of claim 4, wherein the capacitor is included within the first transistor as parasitic capacitance of the gate of the first transistor.

6. A field emission display comprising:

a voltage source for providing a voltage between a positive terminal and a negative terminal;

a grid having a number of apertures, the grid being connected to the positive terminal of the voltage source;

a plurality of row address lines;

a plurality of column address lines;

said row address lines intersecting said column address lines, with the intersection of a single row address line with a single column address line being associated with a single pixel within said display;

a plurality of pixels, wherein each pixel includes a number of field emitters, each field emitter being positioned adjacent an aperture of the grid;

a gating circuit having an output and first and second inputs for receiving first and second input signals, respectively, one of said inputs being coupled to that pixel's associated row address line, and the other input being coupled to that pixel's associated column address line, wherein the gating circuit connects or disconnects the second input signal to the output in response to whether the first input signal is high or low;

a first transistor having gate, drain, and source terminals, the gate being connected to the output of the gating circuit of the pixel, and the drain being connected to the field emitters of the pixel; and an electrical resistance connected between the negative terminal of the voltage source and the source terminal of the first transistor of the pixel.

7. A field emission display comprising:

a voltage source for providing a voltage between a positive terminal and a negative terminal;

a grid having a number of apertures, the grid being connected to the positive terminal of the voltage source;

a plurality of row address lines;

a plurality of column address lines;

said row address lines intersecting said column address lines, with the intersection of a single row address line with a single column address line being associated with a single pixel within said display;

a plurality of pixels, wherein each pixel includes a number of field emitters, each field emitter being positioned adjacent an aperture of the grid;

a first transistor having gate, drain, and source terminals, the drain being connected to the field emitters of the pixel; and an electrical resistance connected between the negative terminal of the voltage source and the source terminal of the first transistor of the pixel; and a second transistor having gate, source and drain terminals, the gate of the second transistor being connected to one of either the column address line or the row address line associated with that particular pixel, the source of the second transistor being connected to the other one of said column address line or row address line associated with that pixel, and the drain of the second transistor being connected to the gate of the first transistor of the pixel.

8. A display according to claim 7, wherein each pixel further comprises a capacitor connected between the gate of the first transistor of the pixel and the negative terminal of the voltage source.

9. A display according to claim 8, wherein the capacitor in each pixel is included within the first transistor of the pixel as parasitic capacitance of the gate of the first transistor of the pixel.

10. Apparatus for controlling the current through a number of field emitters, comprising:

a voltage source for providing a voltage between a positive terminal and a negative terminal;

a grid having a number of apertures, the grid being connected to the positive terminal of the voltage source;

a number of field emitters, each field emitter being positioned adjacent an aperture of the grid;

a first transistor having a source, drain, and gate, the drain of the first transistor being connected to the field emitters;

an electrical resistance connected between the source of the first transistor and the negative terminal of the voltage source; and a circuit for applying a control voltage to the gate of the first transistor.

11. Apparatus according to claim 10, further comprising a capacitor connected between the gate of the first transistor and the negative terminal of the voltage source.

12. Apparatus according to claim 10, wherein the circuit for applying a control voltage to the gate of the first transistor comprises:

a second transistor having a gate and a channel, wherein the channel of the second transistor is connected between the gate of the first transistor and a first input voltage, and the gate of the second transistor is connected to receive a second input voltage.

13. Apparatus according to claim 12, further comprising a capacitor connected between the gate of the first transistor and the negative terminal of the voltage source.

14. A field emission display, comprising:

a voltage source for providing a voltage between a positive terminal and a negative terminal;

a grid having a number of apertures, the grid being connected to the positive terminal of the voltage source;

a plurality of row address signal lines, wherein each respective row address line carries a respective row address electrical signal;

a plurality of column address signal lines, wherein each respective column address line carries a respective column address electrical signal, and wherein the column address lines intersect the row address lines; and a plurality of pixels, each pixel being associated with one of the row address lines and one of the column address lines, wherein each pixel is associated with a corresponding pixel circuit which includes a number of field emitters, each field emitter being positioned adjacent an aperture of the grid, a first transistor having a source, drain, and gate, the drain of the first transistor of the pixel being connected to the field emitters of the pixel, an electrical resistance connected between the source of the first transistor of the pixel and the negative terminal of the voltage source, and a control circuit for supplying to the gate of the first transistor of the pixel a voltage responsive to the signal on one of the address lines associated with the pixel.

15. A display according to claim 14, wherein each pixel further comprises a capacitor connected between the gate of the first transistor of the pixel and the negative terminal of the voltage source.

16. A display according to claim 14, wherein the control circuit of each pixel comprises:

a logical AND gate circuit having an output and having first and second inputs for receiving first and second input signals, respectively, one of said inputs being coupled to the row address line associated with the pixel, and the other input being coupled to the column address line associated with the pixel, wherein the logical AND gate circuit produces at its output a signal which is a logical AND of the first and second input signals.

17. A display according to claim 16, wherein each pixel further comprises a capacitor connected between the gate of the first transistor of the pixel and the negative terminal of the voltage source.

18. A display according to claim 14, wherein the control circuit of each pixel comprises:

a second transistor having a gate and a channel, wherein the channel of the second transistor of the pixel is connected between the gate of the first transistor of the pixel and one of the two address lines associated with the pixel, and the gate of the second transistor is connected to the other one of the two address lines associated with the pixel.

19. A display according to claim 18, wherein each pixel further comprises a capacitor connected between the gate of the first transistor of the pixel and the negative terminal of the voltage source.

20. A field emission display, comprising:

a first voltage source for providing a first voltage between a positive terminal and a negative terminal;

a grid having a number of apertures, the grid being connected to the positive terminal of the voltage source;

a plurality of row address signal lines;

a plurality of column address signal lines, wherein the column address lines intersect the row address lines; and a plurality of pixels, each pixel being associated with one of the row address lines and one of the column address lines, wherein each pixel is associated with a corresponding pixel circuit which includes a number of field emitters, each field emitter being positioned adjacent an aperture of the grid, a first transistor having a gate, a source, and a drain, the source of the first transistor being connected to the negative terminal of the first voltage source, and the drain of the first transistor being connected to the field emitters of the pixel, a second transistor having a gate and a channel, the gate of the second transistor being connected to the row address line associated with the pixel, and a third transistor having a gate and a channel, the gate of the third transistor being connected to the column address line associated with the pixel;

wherein, within each pixel, the respective channels of the second and third transistors of the pixel are connected in series between the gate of the first transistor of the pixel and a second voltage which is positive relative to the negative terminal of the first voltage source.

21. A display according to claim 20, wherein each pixel further comprises:

an electrical resistance connected between the gate of the first transistor of the pixel and the negative terminal of the first voltage source.

22. A display according to claim 20, wherein each pixel further comprises:

an electrical resistance connected between the source of the first transistor of the pixel and the negative terminal of the first voltage source.

23. A field emission display, comprising:

a first voltage source for providing a first voltage between a positive terminal and a negative terminal;

a grid having a number of apertures, the grid being connected to the positive terminal of the voltage source;

a plurality of row address signal lines;

a plurality of column address signal lines, wherein the column address lines intersect the row address lines; and a plurality of pixels, each pixel being associated with one of the row address lines and one of the column address lines, wherein each pixel is associated with a corresponding pixel circuit which includes a number of field emitters, each field emitter being positioned adjacent an aperture of the grid, a first transistor having a gate, a source, and a drain, the gate of the first transistor being connected to a first input of the pixel, the source of the first transistor being connected to the negative terminal of the first voltage source, and the drain of the first transistor being connected to the field emitters of the pixel, and a second transistor having a gate, a source, and a drain, the gate of the second transistor being connected to a second input of the pixel, the source of the second transistor being connected to the negative terminal of the first voltage source, and the drain of the second transistor being connected to the gate of the first transistor of the pixel;

wherein, within each pixel, one of the first and second inputs of the pixel is connected to the row address line associated with the pixel, and the other one of the first and second inputs of the pixel is connected to the column address line associated with the pixel.

24. A display according to claim 23, wherein:

within each pixel, the address line connected to the first input of the pixel carries a logically inverted address signal, and the address line connected to the second input of the pixel carries a logically uninverted address signal.

25. A display according to claim 23, wherein each pixel further comprises:

a diode connected between the first input of the pixel and the gate of the first transistor of the pixel.

26. A display according to claim 25, wherein the diode of each pixel is a third transistor having a source, a drain, and a gate, wherein the source of the third transistor is connected to the gate of the first transistor of the pixel, and wherein the drain and gate of the third transistor are connected to each other and to the first input of the pixel.

27. A method of controlling the current through a number of field emitters, comprising the steps of:

supplying a voltage between a positive terminal and a negative terminal;

providing a grid having a number of apertures;

connecting the grid to the positive terminal;

providing a number of field emitters positioning each field emitter adjacent an aperture of the grid;

providing a first transistor having a source, drain, and gate;

connecting the drain of the first transistor to the field emitters;

connecting an electrical resistance between the source of the first transistor and the negative terminal of the voltage source; and applying a control voltage to the gate of the first transistor.

28. A method according to claim 27, further comprising the step of:

connecting a capacitor between the gate of the first transistor and the negative terminal of the voltage source.

29. A method according to claim 27, wherein the step of applying a control voltage to the gate of the first transistor comprises:

providing a second transistor having a gate and a channel;

connecting the channel of the second transistor between the gate of the first transistor and a first input voltage; and applying a second input voltage to the gate of the second transistor.

30. A method according to claim 29, further comprising the step of:

connecting a capacitor between the gate of the first transistor and the negative terminal of the voltage source.

31. A method of controlling a field emission display, comprising the steps of:

providing a voltage between a positive terminal and a negative terminal;

providing a grid having a number of apertures;

connecting the grid to the positive terminal;

providing a plurality of row address signal lines, wherein each respective row address line carries a respective row address electrical signal;

providing a plurality of column address signal lines, wherein each respective column address line carries a respective column address electrical signal, and wherein the column address lines intersect the row address lines;

providing a plurality of pixel circuits, each pixel circuit being associated with one of the row address lines and one of the column address lines;

providing in each pixel circuit a number of field emitters;

positioning each field emitter adjacent an aperture of the grid;

providing in each pixel circuit a first transistor having a source, drain, and gate;

connecting the drain of the first transistor of each pixel circuit to the field emitters of that pixel circuit;

providing in each pixel circuit an electrical resistance;

connecting the resistance of each pixel circuit between the source of the first transistor of that pixel circuit and the negative terminal; and applying to the gate of the first transistor of each pixel circuit a voltage responsive to the signal on one of the address lines associated with that pixel circuit.

32. A method according to claim 31, further comprising the steps of:

providing a capacitor in each pixel circuit; and connecting the capacitor of each pixel circuit between the gate of the first transistor of that pixel circuit and the negative terminal.

33. A method according to claim 31, wherein the applying step comprises:

providing in each pixel circuit a logical AND gate circuit having an output and having first and second inputs for receiving first and second input signals, respectively; and in each pixel circuit, coupling one of the inputs of the AND gate circuit of that pixel circuit to the row address line associated with that pixel circuit, and coupling the other input of said AND gate cicuit to the column address line associated with that pixel circuit.

34. A method according to claim 33, further comprising the steps of:

providing a capacitor in each pixel circuit; and connecting the capacitor of each pixel circuit between the gate of the first transistor of that pixel circuit and the negative terminal.

35. A method according to claim 31, wherein the applying step comprises:

providing in each pixel circuit a second transistor having a gate and a channel; and in each pixel circuit, connecting the channel of the second transistor of that pixel circuit between the gate of the first transistor of that pixel circuit and one of the two address lines associated with that pixel circuit, and connecting the gate of the second transistor of that pixel circuit between the other one of the two address lines associated with the pixel circuit.

36. A method according to claim 35, further comprising the steps of:

providing a capacitor in each pixel circuit; and connecting the capacitor of each pixel circuit between the gate of the first transistor of that pixel circuit and the negative terminal.

* * * * *